US005287718A

United States Patent [19]

Yamanashi

[11] Patent Number: 5,287,718

[45] Date of Patent: Feb. 22, 1994

[54] CURL FORMING METHOD FOR A CAN END

[75] Inventor: Shigeaki Yamanashi, Yokohama, Japan

[73] Assignee: Toyo Saikan Kaisha, Ltd., Tokyo, Japan

[21] Appl. No.: 4,499

[22] Filed: Jan. 14, 1993

Related U.S. Application Data

[63] Continuation of Ser. No. 817,555, Jan. 7, 1992, abandoned.

[30] Foreign Application Priority Data

Jan. 16, 1991 [JP] Japan ..... 3-14973

[51] Int. Cl.[5] ..... B21D 22/22

[52] U.S. Cl. ..... 72/348; 413/56

[58] Field of Search ..... 413/11, 8, 56; 72/348, 72/350, 351, 347

[56] References Cited

U.S. PATENT DOCUMENTS

| | | | |
|---|---|---|---|
| 1,730,575 | 10/1929 | Hothersall | 413/8 |
| 4,561,280 | 12/1985 | Bachmann et al. | 72/346 |
| 4,567,746 | 2/1986 | Bachmann | 413/56 |
| 4,903,521 | 2/1990 | Bulso, Jr. et al. | 72/336 |

*Primary Examiner*—Jack Lavinder

*Attorney, Agent, or Firm*—Nikaido, Marmelstein, Murray & Oram

[57] ABSTRACT

A curl forming method for a can end which enables satisfactory curl formation in a thin can end without occurrence of wrinkles and without occurrence of scratches on internal surfaces of the can end and which can make a can end thinner. A punched can end is pressed and bended from an open end of annular flange and an opposite side by a primary forming die having an inner diameter larger than a final curl diameter by 0 to 2.0 mm to effect a primary forming, and then it is pressed and bended from the side of the flange open end by a secondary forming punch having a forming surface 14 having a final shape of a curl.

1 Claim, 1 Drawing Sheet

CURL FORMING METHOD FOR A CAN END

This application is a continuation of application Ser. No. 817,555, filed Jan. 7, 1992, now abandoned.

BACKGROUND OF THE INVENTION (1) Field of the Invention

The present invention relates to a curl forming method for a can end in a can end manufacturing process, and more specifically, to a curl forming method for a can end capable of providing curl formation for a thin can end without inducing wrinkles.

(2) Description of the Prior Art

In a conventional curl formation of a can end, a can end punched by a press is formed with a curl by a curl forming apparatus of a rotary rail curl system as shown in FIG. 2. This curl forming apparatus consists of a rotating curling wheel 20, a curling guide segment 21 and a curling center guide 22. A can end 25 is supported by the curling center guide 22. The distance between the curling guide segment 21 and the curling wheel 20 is gradually narrowed while the can end 25 is being sandwiched between the rotating curling wheel 20 and the curling guide segment 21 and rolled whereby the can end is gradually reduced in diameter and subjected to curl forming.

A further method so far proposed is a forming method for performing curling forming using a forming die on the basis of a press system (JPA 60-158930 publication).

Recently, to make a can end material thinner has been strongly demanded in an attempt of saving resources and reducing the cost of can ends. However, when a can end having a thin wall-thickness is subjected to curling by a conventional curl forming apparatus, there arises the following problems. The thickness of a can end material capable of maintaining a good curling work is now at a substantial limit so that it is difficult to make the can end material further thinner.

(1) A slip occurs during curing work to fail to form an outer diameter of a curl into a shape close to round. Wrinkles caused by rolling tend to occur.
(2) Wrinkles are generated in the extreme end of the curl. The wrinkles are grown larger by rolling to lower the sealability of the can end.
(3) The strength in the radial direction of the can end is reduced due to the thinner thickness so that when forming, the internal surface of the can end tends to be flexed, and the internal surface of the can end tends to be damaged by the center guide.
(4) The irregularities in thickness of a curl of a can end increases to make it impossible to accurately manage the number thereof in a bag.
(5) In the case of the press system, a flange end is forced into a curling die from the side of a flange open end and forming is accomplished by one step or process.

Therefore, the extreme end of the curl at which wrinkles tend to occur most easily is reduced in diameter in a free state without being supported. When the wall thickness becomes thin, wrinkles tend to occur extremely easily in that portion.

In the case of the conventional rotary rail system, a can end is inserted into a rail, and forming is accomplished while rolling the can end. Therefore, a uniform peripheral force does not act on the outer peripheral portion of an annular flange of a can end. Further, the can end moves while sliding on the curling center guide. So, when the can end material is thin, occurrence of the aforementioned problems (1) to (4) cannot be avoided.

SUMMARY OF THE INVENTION

An object of the present invention is to provide a curl forming method which can satisfactorily perform curl formation without occurrence of the aforementioned problems (1) to (5) even if the can end material is made thinner than that of prior art and which can make the can end material thinner to reduce the cost.

For achieving the aforesaid object, a curl forming method for a can end according to the present invention comprises a primary forming step for pressing and bending a flange end of a punched can end by a primary forming die having a die hole which is equal to or larger than a final curl diameter to effect a primary forming, and a secondary forming step for further secondary forming said flange end into a final curl shape by a secondary forming punch having a forming surface matched to a final shape of a can end curl.

It is desired that the die hole of the primary forming die is in the range larger than the final curl diameter by 0 to 2.0 mm. The primary forming die and the punched can end are relatively displaced, and the flange end is pressed and bended by the primary forming die from the side opposite to the open end of the annular flange to effect the primary forming. In the secondary forming, a secondary forming punch and a can end are relatively displaced, and a flange end is pressed and bended from the side of the flange open end of the can end by the secondary forming punch to effect the secondary forming.

According to the method of the present invention, curl portions in the outer peripheral edge of the can end are simultaneously formed over the entire circumference. The force uniformly acts in the circumferential direction. Further, since the flange end always moves along the forming surface, even an extremely thin can end never slips during curling work and wrinkles are hard to occur. Since the can end is aligned by the primary forming punch and the secondary forming pad, eccentricity and deformation are hard to occur. Moreover, since the radial force does not act on the central portion of the can end, no flexuture of the can end occurs. Moreover, a center guide or the like which rubs against the internal surface of the can end is not required, and therefore, no scratch is given to the internal surface of the can end. A can end of high quality is obtained. Since the thickness of the curl portion of the can end is less in irregularities and the can end is uniformly formed, it is possible to easily manage the number of can end in a bag.

As described above, according to the present invention, even a can end of extremely thin wall thickness which has been difficult to be satisfactorily formed by a conventional curl forming apparatus can be formed with a curl satisfactorily and accurately. Thereby, it is possible to make a wall thickness of a can end further thinner than that of prior art, and to reduce the cost of a can end.

DESCRIPTION OF THE PREFERRED EMBODIMENTS

Embodiments of a curl forming method for a can end according to the present invention will be described with reference to the drawings.

Figure 1A:
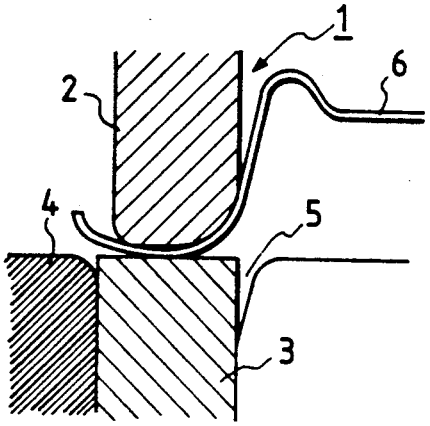
FIGS. 1(A) and (B) are schematic views showing a primary forming step, and FIGS. 1(C) and (D) are schematic views showing a secondary forming step.

The curl forming apparatus for carrying out the method for the present embodiments comprises a primary forming die assembly for carrying out the primary forming, and a secondary forming die assembly for carrying out the secondary forming. As shown in FIGS. 1(A) AND (B), a primary forming die assembly 1 has a vertically movable primary forming punch 2 and a primary forming pad 3. A primary forming die 4 having a die hole 5 having an inner diameter which is larger than a final curl diameter by 0 to 1 mm is fitted in the outer periphery of the primary forming pad 3. The primary forming step is carried out by the primary forming die assembly in the following manner.

When a can end (shell) 6 punched by a press in the previous step is supplied onto the primary forming die 4 by a suitable supplying device with an open end of an annular flange thereof directed upward, the primary forming punch 2 moves down. The can end 6 is held between the punch 2 and the primary forming pad 3 and forced into the die hole 5 whereby the flange end is inwardly forced in by the primary forming die 4 from the side opposite to the flange open end relatively. Thereby, the flange end is raised upwardly as shown in FIG. 1(B) and subjected to the primary forming up to the range wherein the outer diameter thereof is larger than the final curl diameter by 1.0 mm or less.

Figure 1C:
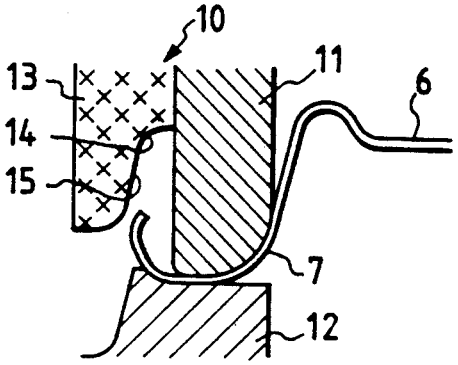
Figure 1B:
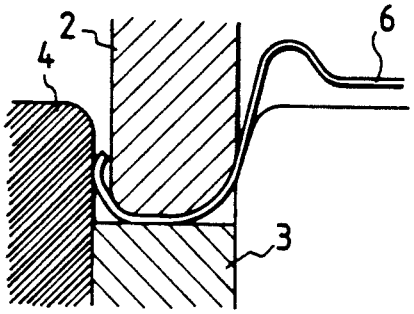
Figure 1D:
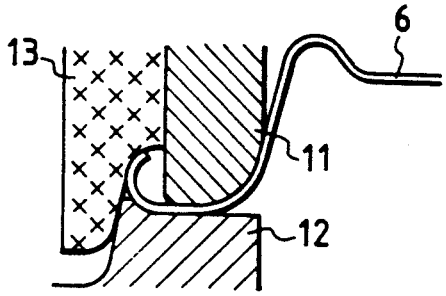
Figure 2:
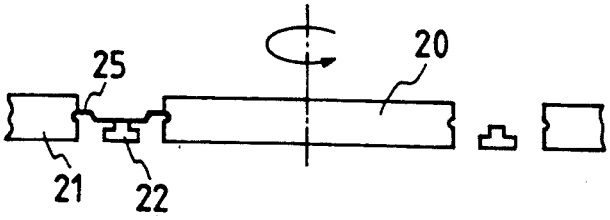
FIG. 2 PRIOR ART
FIG. 2 is a schematic view of a conventional curl forming apparatus.

As shown in FIGS. 1(C) and (D), a secondary forming die assembly 10 for carrying out the secondary forming step has a secondary forming pad 11 and a secondary forming die 12, which are mutually relatively vertically movable, for holding a can end while holding, from up and bottom, a flange portion 7 of a can end 6 raised upwardly in the primary forming step. The secondary forming pad 11 is provided in the outer periphery thereof with a forming surface 14 having a shape matched to a final shape of a can end curl, and a secondary forming punch 13 in which an introducing portion 15 at the extreme end of the forming surface 14 moves beyond a forming surface of the secondary forming die 12 when forming is completed is vertically movably fitted.

When the can end 6 already subjected to the primary forming is supplied by suitable supplying means from the primary forming die assembly 1 to the secondary forming die assembly 10, the flange portion 7 of the can end is held by the secondary forming pad 11 and the secondary forming die 12, under which state the secondary forming punch 13 moves down to force-in the flange edge portion from the side of the flange open end. Thereby, the flange end formed to have the outer diameter larger than the final curl diameter by 1.0 mm or less by the primary forming is formed to be curved along the forming surface 14 from the introducing portion of the secondary forming punch 13 and formed into the final shape. Accordingly, the flange end is subjected to curling while always impinging upon and being restricted by the forming surface of the secondary forming punch. Even a can end having a thin wall-thickness involves no occurrence of wrinkles and no deformation, and satisfactory curling work can be made. Further, since the secondary forming punch has the introducing portion 15, the secondary forming smoothly starts, and the final formed shape is stabilized.

Curl forming was carried out by the aforementioned formed method with respect to an aluminum can end for the case of a wall thickness of 0.20 mm hitherto generally employed and for the case of a wall thickness which is made thin to 0.175 mm and 0.15 mm to observe the status of occurrence of wrinkles. As a comparative example, a can end under the conditions similar to the above was subjected to curl forming by the aforementioned rotary rail type curl forming apparatus.

As the result, in the case of the present embodiment, no occurrence of wrinkles appears in any of three kinds of wall thicknesses, and curl contours were possible to be formed satisfactorily into a shape close to round. Further, no occurrence of scratches to internal surfaces of any of can ends was observed. Moreover, irregularities in curl thickness of a can end were very small.

On the other hand, in case of the comparative example, for the thickness of 0.2 mm, no wrinkle occurs and satisfactory forming was accomplished. However, for the thin thickness, 0.175 mm and 0.15 mm, wrinkles occurred in the curl portion, the curl contour was the shape deformed from round, and satisfactory forming was impossible to carry out. Moreover, the irregularities in curl thickness were so large that the management of the number in a bag cannot be made. The occurrence of scratches in the internal surface of the can end was found.

It has been assured from the above-described embodiments that the curl forming method according to the present invention was extremely effective as a curl forming method for a thin can end as compared with the conventional forming method. However, the present invention is not limited to the aforementioned embodiments but a change in design can be suitably made within the scope of technical idea thereof. For example, while in any of the primary and secondary forming die assemblies in the aforementioned embodiments, the forming punch is moved to effect working, it is to be noted that the forming apparatus can be suitably changed in design such that the forming die or both the forming punch and forming die are moved to effect working.

What is claimed is:

1. A curl forming method of a can end for forming a curl on a flange end of the can end for attaching the can end on a can body, said method comprising the steps of:

supplying a can end having a flange between a primary forming punch and a primary forming pad arranged opposite to said primary forming punch;

holding securely said flange of said can end by said primary forming punch and said primary forming pad such that an extreme end of said flange is protruded radially outwardly from an outer peripheral portion of said primary forming punch and said primary forming pad;

a primary forming step of forming a primary curl on the extreme end of said flange by forcing said flange into a die hole of a primary forming die from a side opposite to an open end of said flange, while holding said flange by said primary forming punch and said primary forming pad, said primary forming die being movably arranged relative to the outer peripheral portion of said primary forming pad, said die hole being larger by 0 to 2.0 mm than a diameter of a final curl of said extreme end of said flange, so that the extreme end is inwardly bent to form a primary curl on the flange during the relative movement between the primary forming die and the primary punch and pad assembly;

supplying the can end formed with the primary curl on said flange between a secondary forming pad and a secondary forming die arranged opposite to said secondary forming pad;

holding securely said flange of said can end by said secondary forming pad and said secondary forming die such that the extreme end of said flange is protruded radially outwardly from the outer peripheral portion of said secondary forming pad; and a secondary forming step of forming a final curl shape on the extreme end of curl on said flange by which a secondary forming punch movably arranged relative to the outer peripheral portion of said secondary forming pad, and having a forming surface matched to said final curl shape of the flange end, is relatively moved substantially orthogonally to the plane of the can end from the open side of the primary curl of said can end toward the flange end, whereby the extreme end of the flange end is pressed and bent by said secondary forming punch to form the extreme end of the flange end into the final curl shape.

* * * * *